US008342620B2

(12) United States Patent
Kasai et al.

(10) Patent No.: US 8,342,620 B2
(45) Date of Patent: Jan. 1, 2013

(54) DRIVING DEVICE, RECORDING HEAD, AND APPARATUS USING THE SAME

(75) Inventors: Ryo Kasai, Tokyo (JP); Nobuyuki Hirayama, Fujisawa (JP); Tatsuo Furukawa, Zama (JP); Kimiyuki Hayasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

(21) Appl. No.: 12/965,716

(22) Filed: Dec. 10, 2010

(65) Prior Publication Data

US 2011/0273498 A1 Nov. 10, 2011

(30) Foreign Application Priority Data

May 10, 2010 (JP) ..... 2010-108791

(51) Int. Cl.
*B41J 29/38* (2006.01)

(52) U.S. Cl. ..... 347/5; 347/9; 347/13

(58) Field of Classification Search ..... 347/5, 9, 347/13, 19

See application file for complete search history.

(56) References Cited

U.S. PATENT DOCUMENTS 5,357,268 A * 10/1994 Kishida et al. ..... 347/13
6,116,714 A 9/2000 Imanaka
6,619,775 B2 * 9/2003 Tsuruoka ..... 347/5

FOREIGN PATENT DOCUMENTS

JP 7-256883 A 10/1995

* cited by examiner

*Primary Examiner* — Lam S Nguyen
(74) *Attorney, Agent, or Firm* — Canon USA, Inc., IP Division

(57) ABSTRACT

According to an aspect of the present invention, a high-resolution, small-size, low-cost driving device includes a clock signal generating unit configured to receive a first clock signal of a differential signaling system and generate a second clock signal, an input unit configured to input a data signal which includes first information and second information, a first timing generating unit configured to select an edge of the second clock signal based on the first information and to generate a first signal by counting occurrences of the selected edge a second timing generating unit configured to select edge of the second clock signal based on the second information and to generate a second signal by counting occurrences of the selected edge, a logical circuit configured to generate a pulse signal based on the first and second signals, and a driving element configured to drive a driven element using the pulse signal.

6 Claims, 9 Drawing Sheets

DRIVING DEVICE, RECORDING HEAD, AND APPARATUS USING THE SAME

BACKGROUND OF THE INVENTION

1. Field of the Invention

The present invention relates to a driving device including a signal generating circuit that generates pulse signals.

2. Description of the Related Art

A serial transfer system has been used to transfer a multi-bit data signal because the system requires only a limited number of signal lines and signal terminals. Japanese Patent Application Laid-Open No. 7-256883 discusses a technique to transfer control information such as a driving period of a recording head together with recording data from a recording apparatus to the recording head. Based on the control information, a HE signal to drive a driven element (a recording element) can be generated.

In the prior art, however, it is difficult to increase the resolution of the signal to drive the driven element. For example, according to the structure discussed in Japanese Patent Application Laid-Open No. 7-256883, generation of a signal having a resolution of 10 ns requires a clock frequency of 100 MHz. Alternatively, ten systems different in clock frequencies of 10 MHz may be prepared, so that phases of the signals are offset from one another. These methods, however, greatly increase manufacturing cost and substrate area.

SUMMARY OF THE INVENTION

According to an aspect of the present invention, a driving device includes a clock signal generating unit configured to receive a first clock signal of a differential signaling system and generate a second clock signal from the first clock signal, an input unit configured to input a data signal, a first timing generating unit configured to select either a rising edge or a falling edge of the second clock signal based on first information included in the data signal and to generate a first signal by counting the selected edge of the second clock signal based on the first information, a second timing generating unit configured to select either a rising edge or a falling edge of the second clock signal based on second information included in the data signal and to generate a second signal by counting the selected edge of the second clock signal based on the second information, a logical circuit configured to generate a pulse signal based on the first signal and the second signal, and a driving circuit configured to drive a driven element using the pulse signal generated by the logical circuit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
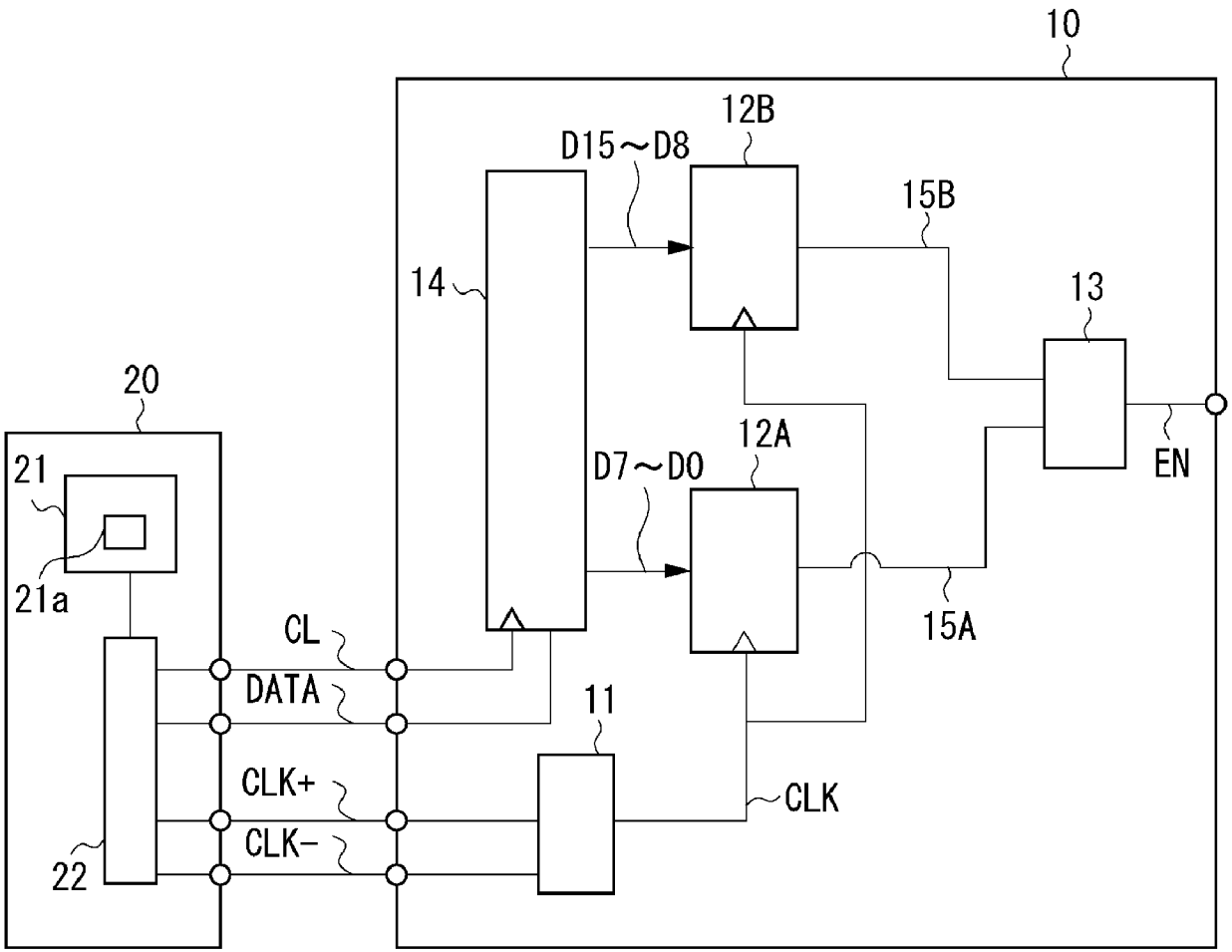
FIG. 1 illustrates a circuit configuration of a signal generating apparatus according to a first exemplary embodiment of the present invention.

FIG. 1 illustrates a signal generating apparatus which generates a pulse signal P to control driving of a driven element. A signal generating apparatus 10 serially receives data signals (DATA) based on clock signals (CL). The signal generating apparatus 10 uses low voltage differential signaling (LVDS) to input clock signals (CLK+ and CLK−).

The clock signals (CL) are fed via an unbalanced line from an external device (e.g., an apparatus 20). Such clock signals (CL) are called single end signals. In contrast, clock signals (CLK+ and CLK−) are fed via a balanced line from the electronic apparatus 20. Such clock signals (CLK+ and CLK−) are called differential signals.

Signal transfer using a differential signaling system can minimize an effect of radiation noise in a transmission line, and achieve data transfer at a higher speed than in the case of the single end signal, leading to high time resolution of signals to be generated.

The signal generating apparatus 10 includes a signal generating unit (clock signal generating unit) 11 configured to generate a clock signal CLK based on clock signals (CLK+ and CLK−). The signal generating apparatus 10 includes an input unit 14 configured to input data signal (DATA) based on the clock signal (CL). The input unit 14 may be a shift register (SR) 14 that inputs data signal (DATA) of 16-bit information D0 to D15.

The signal generating apparatus 10 includes a first timing generating unit 12A. The first timing generating unit 12A selects either a rising edge or a falling edge of the clock signal (CLK) based on first information (8-bit data of D15 to D8) in the data signal. Based on the first information, the first timing generating unit 12A counts the sequential occurrences of the selected edge of the clock signal (CLK) to generate a first signal (15A). The signal generating apparatus 10 further includes a second timing generating unit 12B. Similarly, the second timing generating unit 12B selects either the rising edge or the falling edge of the clock signal (CLK) based on second information (8-bit data of D0 to D7) in the data signal. Based on the second information, the second timing generating unit 12B counts the sequential occurrences of the selected edge of the clock signal (CLK) to generate a second signal (15B).

The signal generating apparatus 10 further includes a logical circuit 13 which generates a pulse signal (EN) based on the first and second signals. The first and second timing generating units 12A and 12B input information by a timing Ts before the clock signal (CLK) is input. The clock signal (CLK) is stopped after a predetermined number of pulses are transferred. This transfer sequence is periodically repeated.

Figure 2:
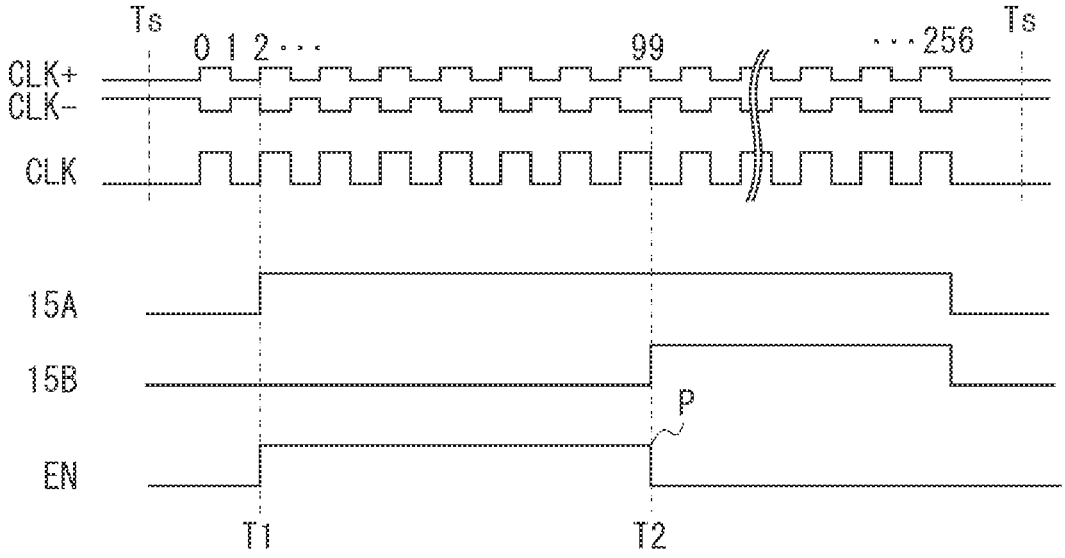
FIG. 2 is a timing chart of the signal generating apparatus according to the first exemplary embodiment.

FIG. 2 is a timing chart illustrating signals generated by the signal generating apparatus 10. FIG. 2 illustrates waveforms of signals output as results of counting by the first and second timing generating units 12A and 12B. In the illustrated case, the first timing generating unit 12A selects the rising edge of the clock signal (CLK), counts the sequential occurrences of the rising edge, and switches the first signal 15A from a low level to a high level at the timing T1. The second timing generating unit 12B selects the falling edge of the clock signal (CLK), counts the sequential occurrences of the falling edge, and switches the second signal 15B from the low level of to the high level at the timing T2. The logical circuit 13 calculates a logical product of these signals (i.e., AND operation), and supplies a pulse P to a signal EN.

The apparatus 20 includes a control circuit 21 and a transmission control circuit 22. The control circuit 21 includes a register 21*a* that stores 16-bit information, for example. The control circuit 21 transmits the information stored in the register 21*a* to the transmission control circuit 22. The transmission control circuit 22 transfers data, the clock signals (CLK+ and CLK−), the clock signal (CL), and the like to the signal generating apparatus 10.

As described above, either the rising edge or the falling edge of the clock signal (CLK) is selectively used to the effective timings (T1 and T2 in FIG. 2) determined by the signal EN. Accordingly, it can double the solution of an effective (high level) period of the signal EN as compared with that in the case either the rising edge or the falling edge of the clock signal (CLK) is fixedly used.

Figure 3:
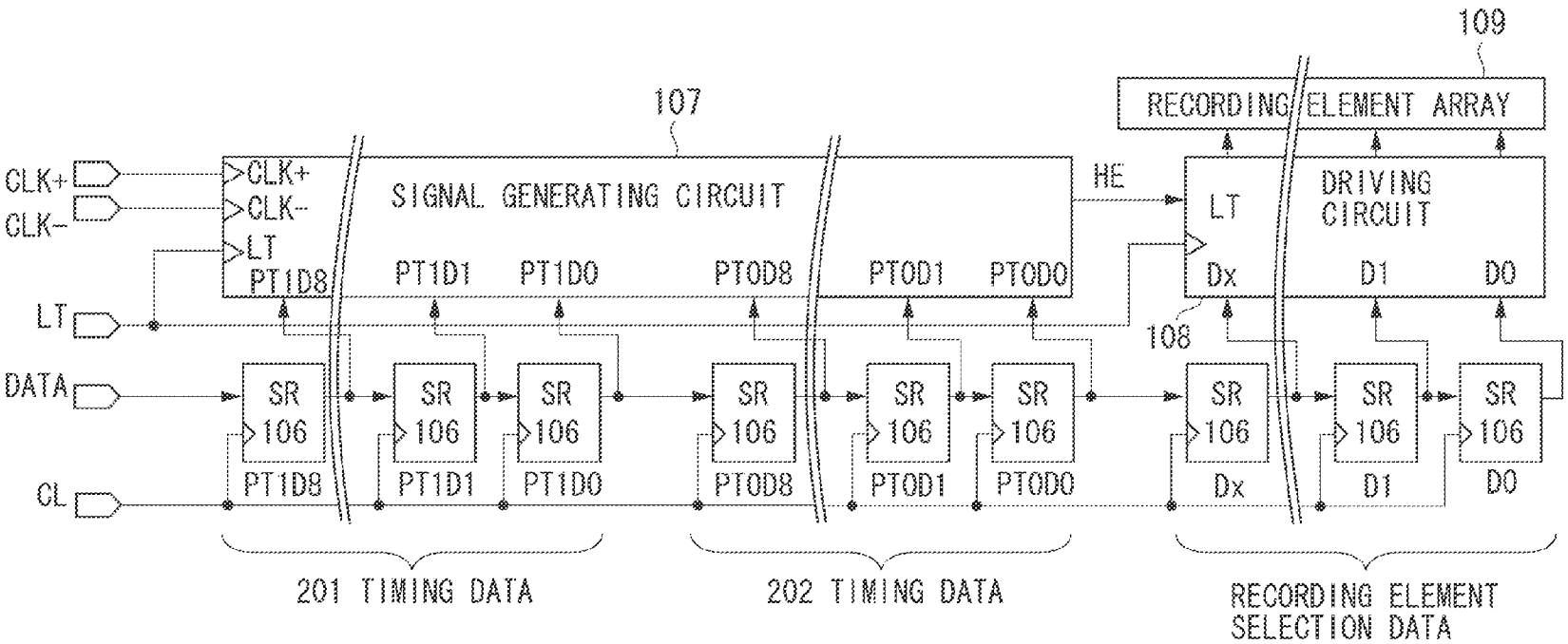
FIG. 3 illustrates a configuration of an apparatus according to a second exemplary embodiment.

FIG. 3 illustrates circuits in the apparatus (driving device) 10 of FIG. 1 in more detail. In a second exemplary embodiment, an apparatus 10 includes a driving circuit 108 for driving a recording element array 109 in which a plurality of recording elements 110 are arranged, a signal generating circuit 107 for generating an enable signal (HE) that defines a period when the recording elements 110 are driven, and a shift register (SR) 106 that inputs data. DATA is acquired by the shift register 106 in synchronization with a CL signal, and is input to the signal generating circuit 107 and the driving circuit 108 at timing of rising of a latch timing (LT) signal. The CL signal may have a frequency value equal to or less than those of the clock signals (CLK+ and CLK−).

Figure 4:
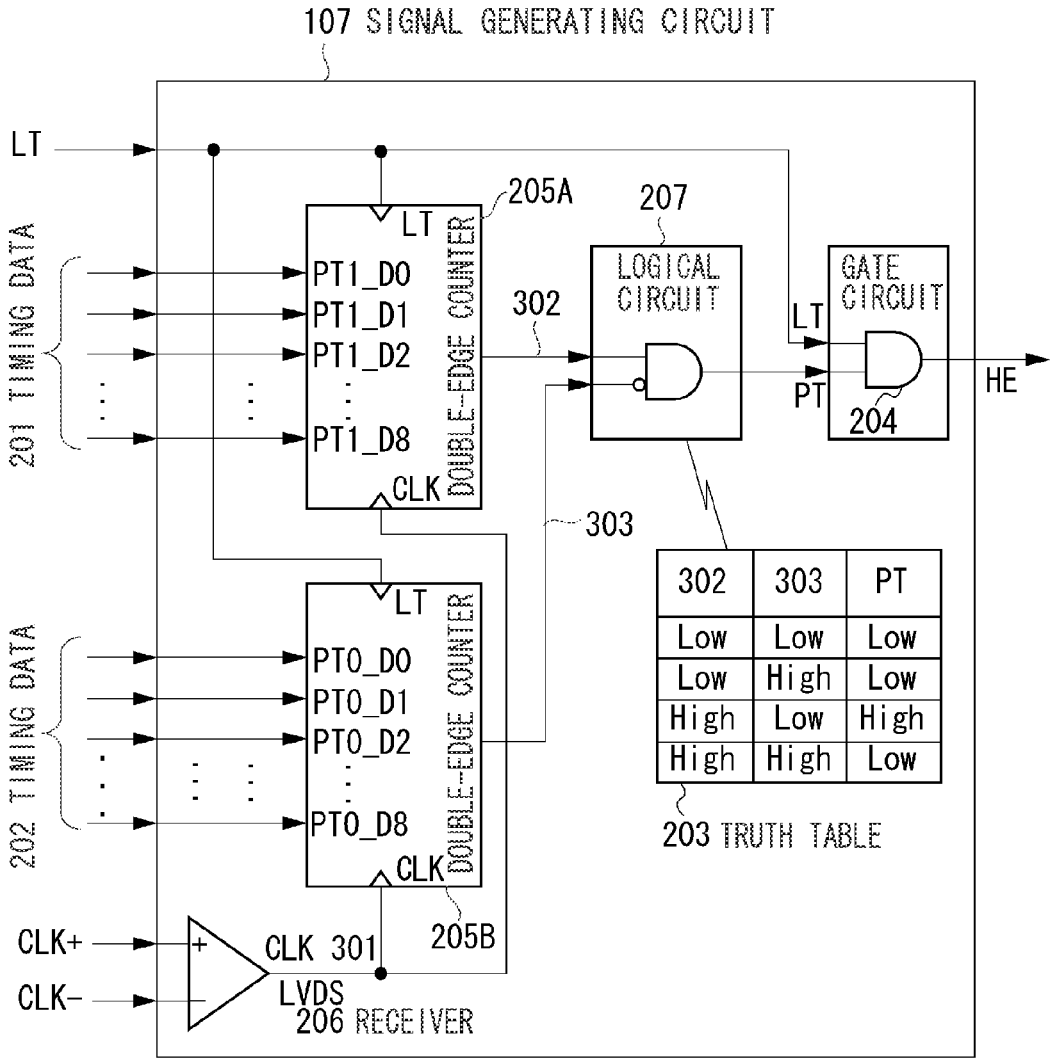
FIG. 4 illustrates a configuration of a signal generating circuit according to the second exemplary embodiment.

FIG. 4 is a block diagram illustrating the signal generating circuit 107. The signal generating circuit 107 generates an enable signal with a single pulse (rectangular pulse) illustrated in FIG. 2.

The signal generating circuit 107 includes double-edge counters 205A and 205B, an LVDS receiver 206, a logical circuit 207, and a gate circuit 204. The double-edge counter (timing generating unit) 205A receives timing data 201, and the double-edge counter (timing generating unit) 205B receives timing data 202.

Figure 5:
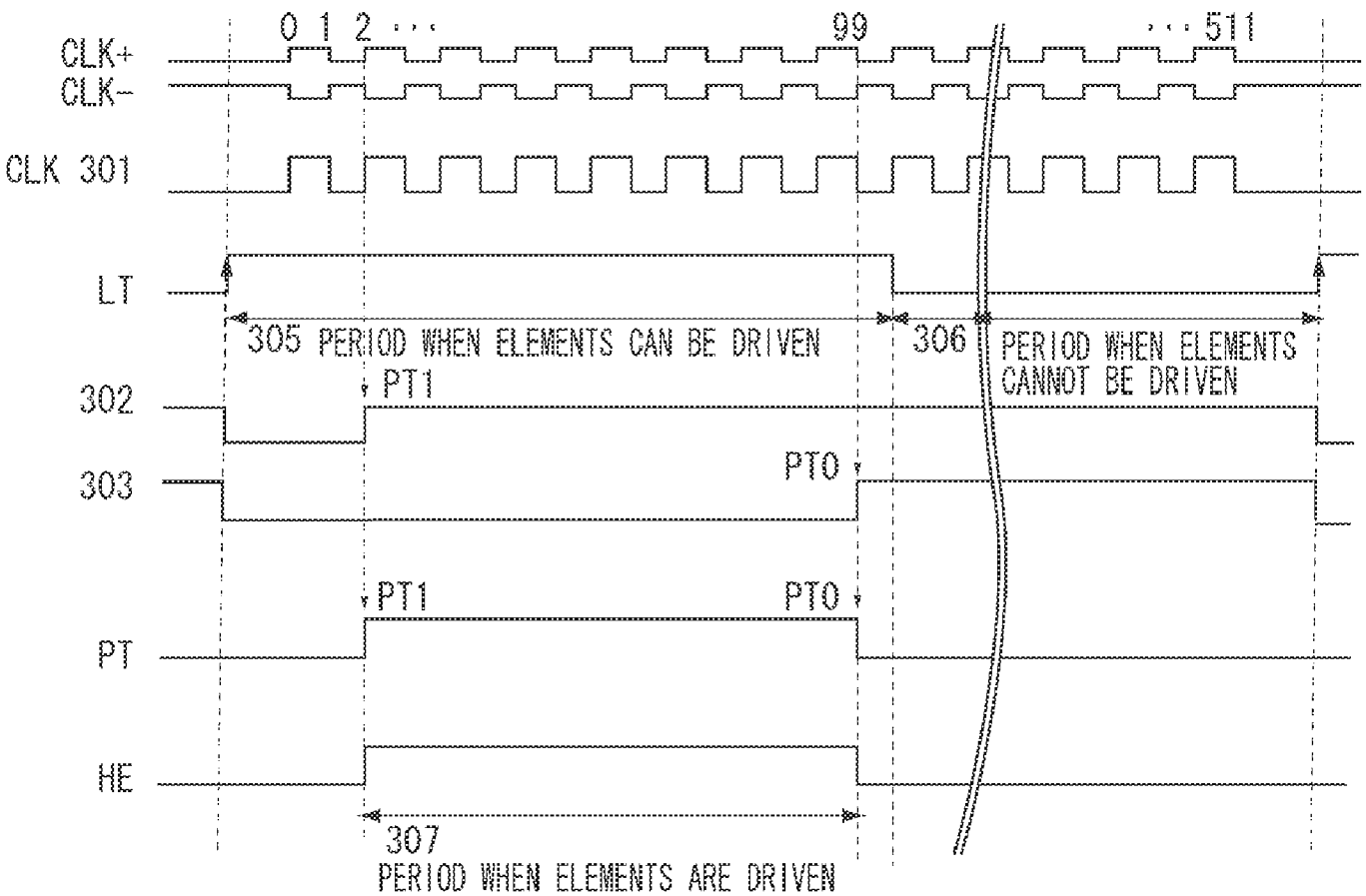
FIG. 5 is a timing chart of signals generated in the second exemplary embodiment.

FIG. 5 is a timing chart illustrating input and output signals generated by the signal generating circuit 107 and signals in the circuit. The timing data 201 consists of 9 bits from PT1D0 to PT1D8 that are used to define the timing of a rising edge of a HE signal. The timing data 202 consists of 9 bits from PT0D0 to PT0D8 that are used to define the timing of a falling edge of a HE signal. Based on these set timings, a period 307 when the HE signal is enabled (when the recording elements can be driven) is determined.

For example, if a PT1 value is set to 2, a HE signal rises at the second rising edge of the CL signal as illustrated in FIG. 5. Similarly, by setting a PT0 value, a HE signal falls at the timing corresponding to the set value. By setting a PT1 value to be equal to a PT0 value, the driving of recording elements can be prevented.

The timing data 201 transmitted from the shift register 106 is set into the double-edge counter 205A at the timing of the rising edge of the LT signal. Similarly, the timing data 202 is set into the double-edge counter 205B at the timing of the rising edge of the LT signal. The double-edge counters 205A and 205B are synchronized with both of the rising and falling edges of a CLK signal 301, and start to count down based on the set values of the timing data 201 and 202. When counting is finished, the double-edge counters 205A and 205B output carry signals 302 and 303 respectively, and stop their operations.

A logical circuit 207 receives the carry signals 302 and 303, and outputs a pulse timing (PT) signal. The logical circuit 207 outputs the PT signal according to logic a truth value table 203. The gate circuit 204 receives the PT signal, performs an AND operation on the LT signals, and outputs the result as a HE signal. Based on the HE signal, the recording elements are driven which causes ink to be ejected from recording heads.

Figure 6:
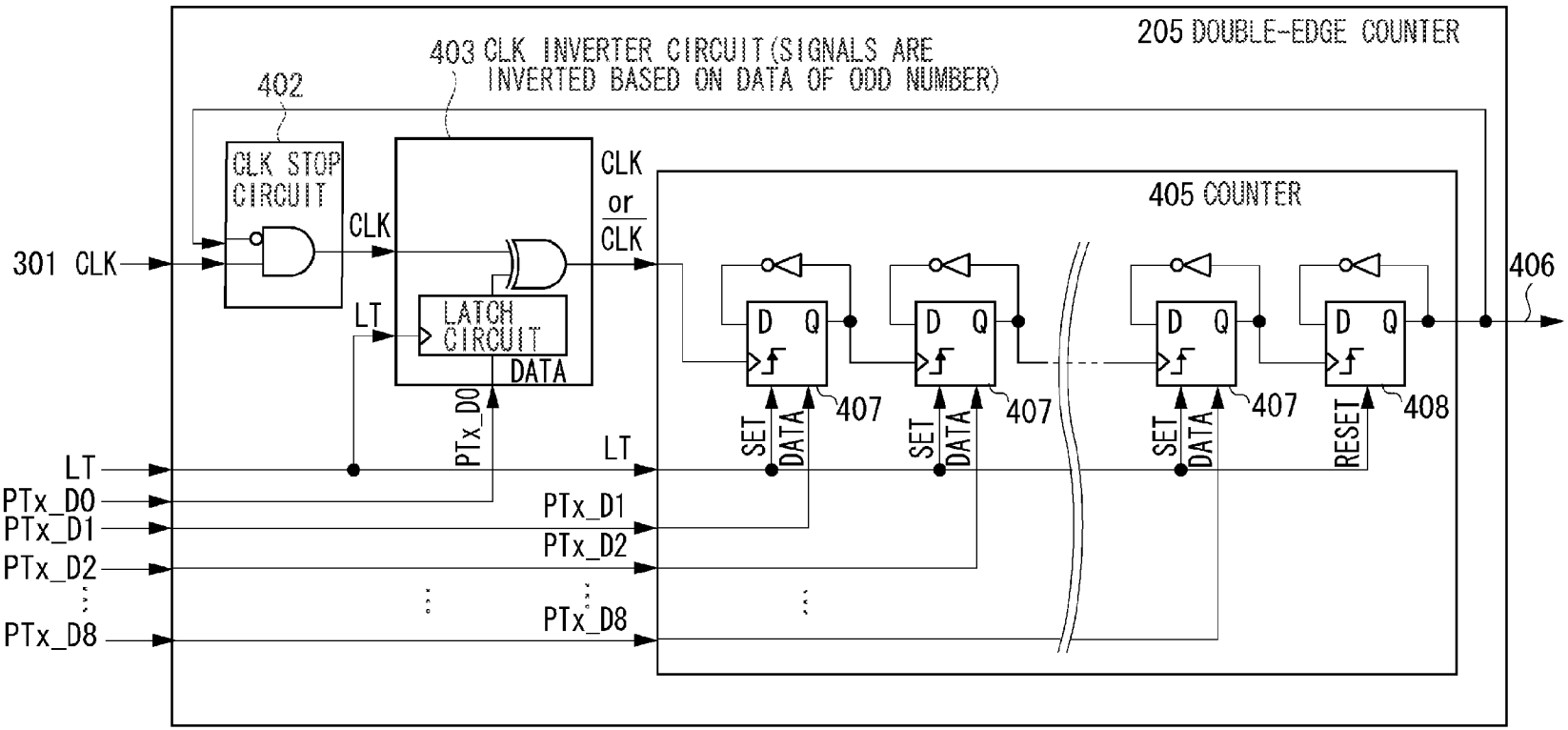
FIG. 6 illustrates a configuration of a signal generating circuit according to the second exemplary embodiment.

FIG. 6 illustrates a double-edge counter (timing generating unit) 205. The double-edge counter 205 includes a 9-bit counting circuit (an asynchronous counter) 405, a CLK inverter circuit 403, and a CLK stop circuit 402. The double-edge counter 205 receives the CLK signal 301, the LT signal, and the timing data 201 or 202.

The timing data 201 (202) corresponds to the bit components PTxD0 to PTxD8 in FIG. 5. The CLK inverter circuit 403 receives the PTxD0 (a predetermined bit) that is a least significant bit (LSB) among the bit components PTxD0 to PTxD8. The CLK inverter circuit 403 outputs a CLK signal if the LSB is an even number, and outputs an inverted CLK signal if the LSB is an odd number. In other words, when a bit component of an even number among PTxD0 to PTxD8 is received, the CLK inverter circuit 403 outputs a CLK signal, and when a bit component of an odd number is received, the CLK inverter circuit 403 outputs an inverse signal of the CLK signal.

The counter 405 receives the output from the CLK inverter circuit 403. The counter 405 is a 9-bit asynchronous down counter for counting rising edges. By a combination with the CLK inverter circuit 403, the counter 405 as a single-edge counter can be operated similarly to a double-edge counter. The counter 405 receives the bit components PTxD1 to PTxD8. The counter 405 is provided with eight D flip flops 407 and one D flip flop 408.

The D flip flops 407 each set the bit components PTxD1 to PTxD8 at the timing of risings of the LT signal. The value of the D flip flop 408 for the ninth bit (for output) is reset at the timing of rising of an LT signal. The counter 405 is synchronized with the rising edges of the output CLK signals from the CLK inverter circuit 403, and counts down from the set value. The output from the D flip flop 408 when the counter value returns from '000H' ('000000000B') to '1FFH' (111111111B) is output as a carry signal 406. The carry signal 406 is received by the logical circuit 207 in FIG. 4. The output from the counter 405 is input to the CLK stop circuit 402, causing the counter 405 to stop the operation.

The double-edge counter 205 is driven at a speed that corresponds to a half of a time resolution of a generated HE signal. This is achieved by selecting either a rising edge or a falling edge based on a value counted in advance and counting the selected edges. Accordingly, an actual driven frequency of the counter is half of that in the case with a double-edge counter. Therefore, power consumption of the double-edge counter 205 will be half and a drive critical frequency thereof will be doubled. An asynchronous counter has a constant operation critical frequency if a number of bits is increased, so that the asynchronous counter is suitable for counting higher values at higher speed. The circuit configuration of such counter is simpler than that of a synchronous counter for the same number of bits, so that shrink of its chip size can be realized.

Figure 7:
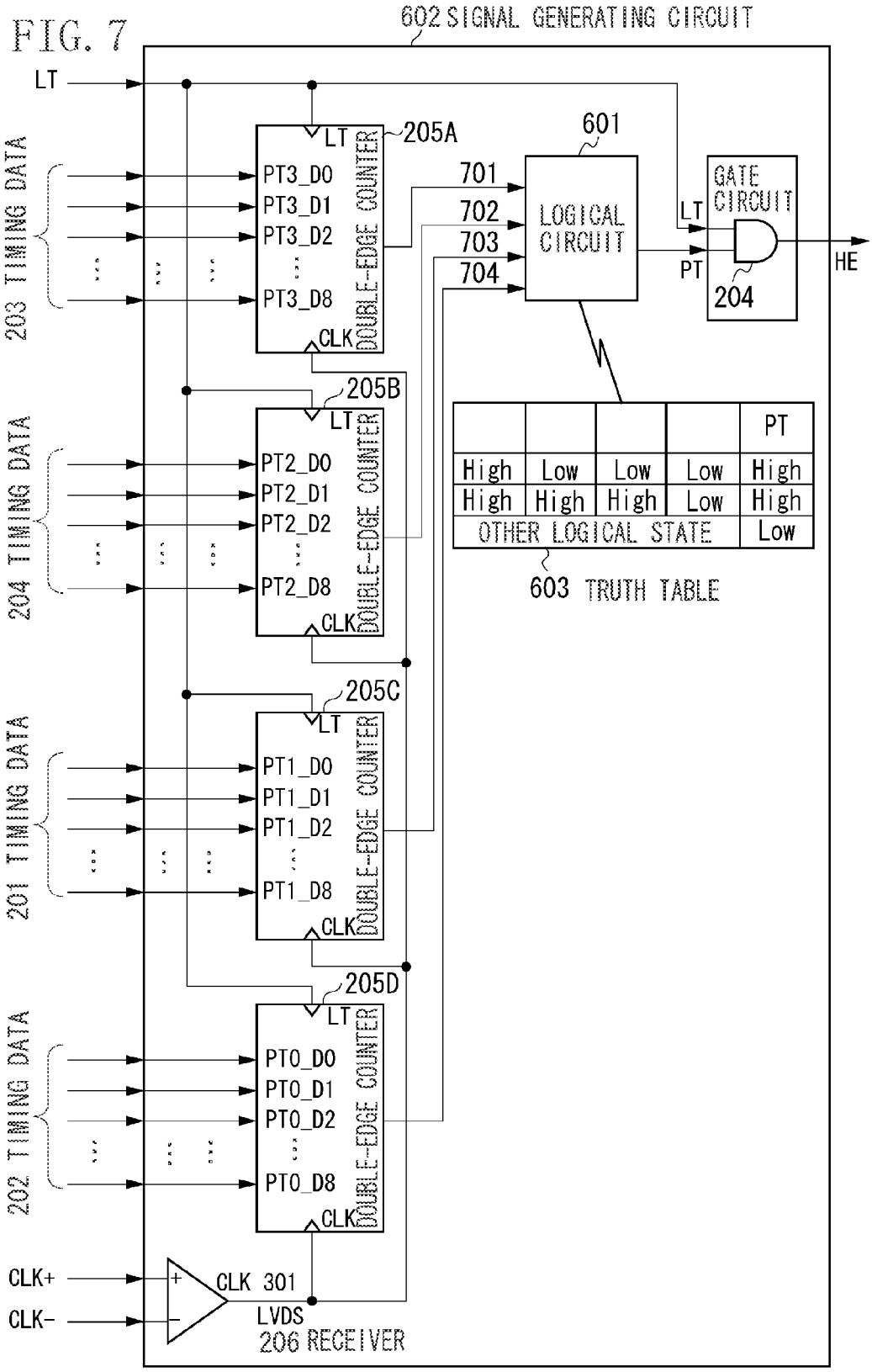
FIG. 7 illustrates a signal generating circuit according to a third exemplary embodiment.

The signal generating circuit 107 according to the second exemplary embodiment generates an enable signal consisting of a single pulse (rectangular pulse). In a third exemplary embodiment, a signal generating circuit 602 illustrated in FIG. 7 is described which has a circuit configuration for generating signals each consisting of a plurality of pulses. In the present exemplary embodiment, difference between the signal generating circuit 602 in FIG. 7 and the signal generating circuit 107 according to the first exemplary embodiment will be described, and description of similar points are not repeated. The signal generating circuit 602 differs from the signal generating circuit 107 according to the first exemplary embodiment in that the signal generating circuit 602 includes four double-edge counters 205A to 205D, and that a logical circuit 601 performs logical operations for four signals.

The double-edge counters 205A to 205D each operates in the similar way to the double-edge counters 205A and 205B in the first exemplary embodiment. The double-edge counter 205A outputs a carry signal 701. Similarly, the double-edge counter 205B outputs a carry signal 702, the double-edge counter 205C outputs a carry signal 703, and the double-edge counter 205D outputs a carry signal 704. The logical circuit 601 receives the carry signals 701 to 704, and outputs a PT signal based on a truth value table 603.

Figure 8:
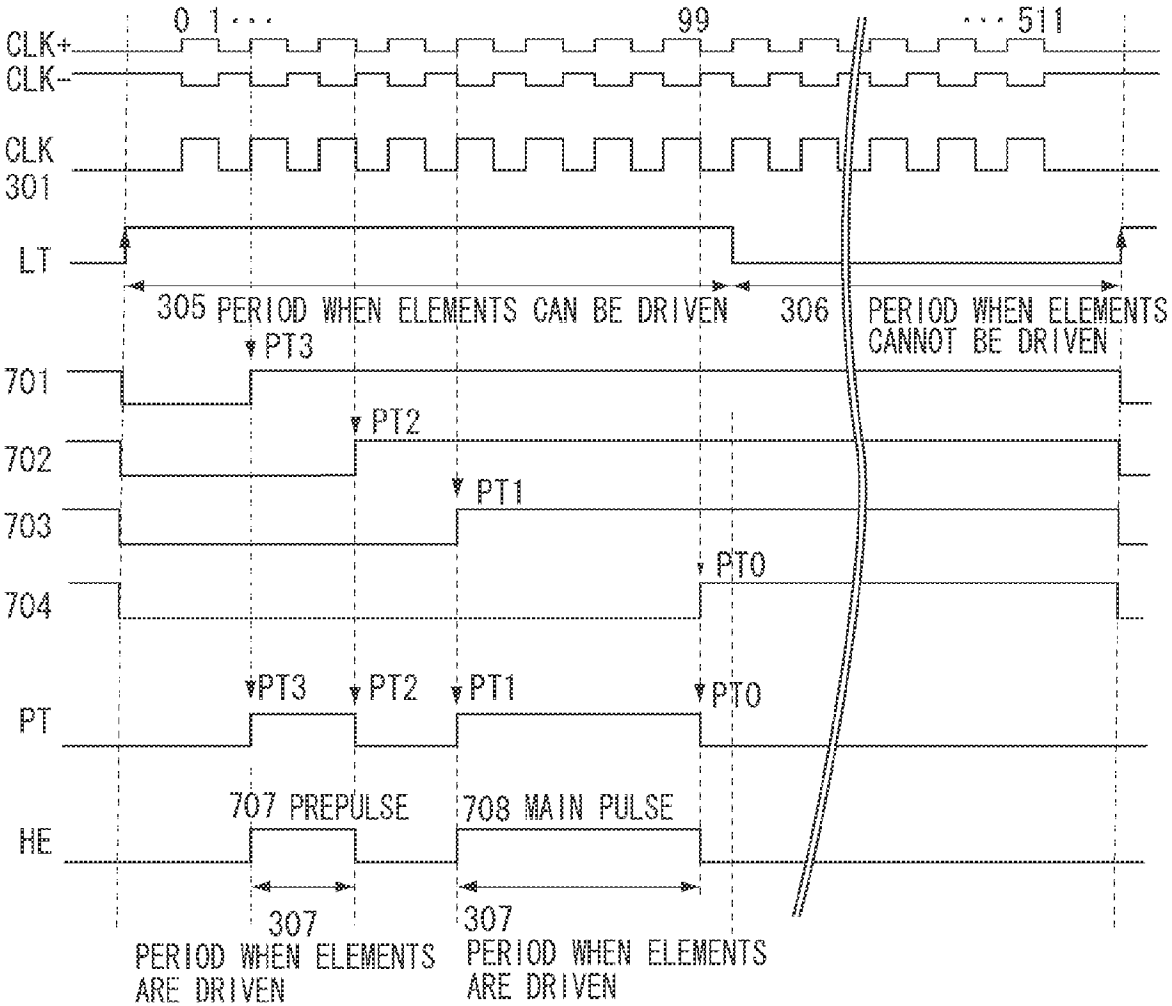
FIG. 8 is a timing chart of signals generated in the third exemplary embodiment.

FIG. 8 is a timing chart illustrating signals generated by the signal generating circuit 602 in FIG. 7. An output of a PT signal generates a pre-pulse 707 and a main pulse 708 of an HE signal.

Figure 9:
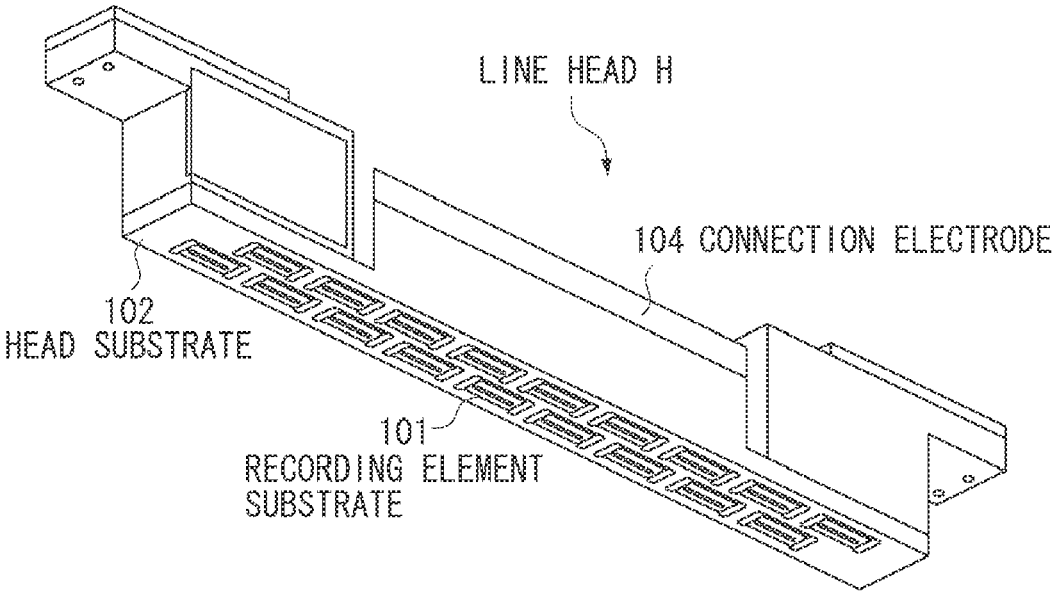
FIG. 9 illustrates an appearance of an apparatus to which the exemplary embodiments of the present invention are applied.

FIG. 9 illustrates a line head (recording head) H as an example of the above described apparatus (driving device) 10. The line head H includes arrangement of a plurality of recording element substrates 101. A head substrate 102 is a wiring substrate having an electrical wiring structure with a flexible printed circuit (FPC), a printed circuit board (PCB), a ceramic board, or the like.

The recording element substrates 101 are electrically connected to the head substrate 102 using wire bonding, or the like. The circuit in FIG. 3 is, for example, disposed on the recording element substrate 101. A connection electrode 104 includes a terminal to receive the DATA signal, the LT signal, and a CL signal in FIG. 3. The apparatus 20 includes a conveyance unit for conveying a recording medium. The apparatus 20 may be a recording apparatus including a feeding unit for feeding a recording medium to the conveyance unit and a discharge unit for discharging the recording medium after recording.

While a signal generating circuit for generating a pulse signal and a driving device including the signal generating circuit have been described, a driven element in the device is not limited to a recording element, and may be a light emitting element for display apparatus, a line sensor applied for a reading apparatus, a direct current (DC) motor, or a stepping motor. Accordingly, the driving circuit described in the second exemplary embodiment may be a circuit for driving a light emitting element, a line sensor, or a motor, respectively.

In the above exemplary embodiments, the counter 405 illustrated in FIG. 6 counts rising edges, but may count falling edges. Further, values of parameters for the above described circuits (e.g., the number of bits of data stored in a register, the number of bits of timing data, and the number of counters) may be different from those described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-108791 filed May 10, 2010, which is hereby incorporated by reference herein in its entirety.

What is claimed is:

1. A driving device, comprising:

a clock signal generating unit configured to receive a first clock signal of a differential signaling system and generate a second clock signal from the first clock signal;

an input unit configured to input a data signal;

a first timing generating unit configured to select either a rising edge or a falling edge of the second clock signal based on first information included in the data signal and to generate a first signal by counting sequential occurrences of the selected edge of the second clock signal based on the first information;

a second timing generating unit configured to select either a rising edge or a falling edge of the second clock signal based on second information included in the data signal and to generate a second signal by counting sequential occurrences the selected edge of the second clock signal based on the second information;

a logical circuit configured to generate a pulse signal based on the first signal and the second signal; and a driving circuit configured to drive a driven element using the pulse signal generated by the logical circuit.

2. The driving device according to claim 1, wherein the input unit includes a shift register that inputs the data signal based on a third clock signal.

3. The driving device according to claim 1, wherein the first timing generating unit includes a circuit that inverts a waveform of the second clock signal based on a predetermined bit value of the first information, and wherein the second timing generating unit includes a circuit that inverts the waveform of the second clock signal based on a predetermined bit value of the second information.

4. The driving device according to claim 1, wherein the first timing generating unit and the second timing generating unit each includes an asynchronous count circuit.

5. The driving device according to claim 1, further comprising a recording head for discharging ink.

6. A recording apparatus including the recording head according to claim 5.

* * * * *